US012446661B2

(12) United States Patent
Ehring

(10) Patent No.: US 12,446,661 B2
(45) Date of Patent: Oct. 21, 2025

(54) TOE CAP AND METHOD FOR PRODUCING A TOE CAP

(71) Applicant: Engelbert Strauss GmbH & Co. KG, Biebergemünd (DE)

(72) Inventor: Lukas Ehring, Linsengericht (DE)

(73) Assignee: Strauss IP GMBH & Co. KG, Biebergemünd (DE)

( * ) Notice: Subject to any disclaimer, the term of this patent is extended or adjusted under 35 U.S.C. 154(b) by 0 days.

(21) Appl. No.: 18/499,434

(22) Filed: Nov. 1, 2023

(65) Prior Publication Data

US 2024/0138521 A1 May 2, 2024

(30) Foreign Application Priority Data

Nov. 1, 2022 (DE) ..... 10 2022 128 872.2

(51) Int. Cl.
*A43D 11/12* (2006.01)
*A43B 17/16* (2006.01)

(52) U.S. Cl.
CPC ..... *A43B 17/16* (2013.01); *A43D 11/12* (2013.01); *A43D 2200/60* (2013.01)

(58) Field of Classification Search
CPC ..... A43D 47/00; A43D 1/02; A43B 17/16
USPC ..... 36/77 R
See application file for complete search history.

(56) References Cited

U.S. PATENT DOCUMENTS

2008/0115387 A1 5/2008 Walworth et al.
2010/0236105 A1* 9/2010 Almaguer ..... A43D 1/08 36/77 R
2011/0185602 A1* 8/2011 Kurth ..... A43B 3/0057 36/77 R
2014/0115795 A1* 5/2014 Almaguer ..... A43B 23/082 702/155
2016/0316853 A1 11/2016 Iuchi et al.
2018/0125170 A1* 5/2018 Hill ..... G05B 19/402
2019/0269199 A1 9/2019 Freed
(Continued)

FOREIGN PATENT DOCUMENTS

EP 1 066 786 A1 1/2001
EP 2 286 686 A1 2/2011
EP 2 298 112 A1 3/2011
(Continued)

OTHER PUBLICATIONS

European Search Report, dated Sep. 17, 2024, corresponding to EP Application No. 23206958.3.

*Primary Examiner* — Timothy K Trieu
(74) *Attorney, Agent, or Firm* — LADAS & PARRY LLP; Malcolm J. MacDonald

(57) ABSTRACT

The invention relates to a method for producing a toe cap (10) and such a toe cap itself. The toe cap comprises at least one end wall (12) extending in an arch shape and a cover wall (14) extending therefrom that covers the toes on the upper side, wherein the cover wall and the end wall have a base wall thickness G and areas separated from sections of the walls, such as webs in the walls, have a thickness D with $0 \leq D < W$, wherein the difference between the volume of the toe cap with areas filled to the base wall thickness W and the volume of the toe cap with the areas of lesser thickness is 5% to 35%, and/or the difference between the area of the toe cap with filled areas and the outer surface of the toe cap without the areas is 20% to 60%.

11 Claims, 6 Drawing Sheets

(56) References Cited

U.S. PATENT DOCUMENTS

Figure 1:
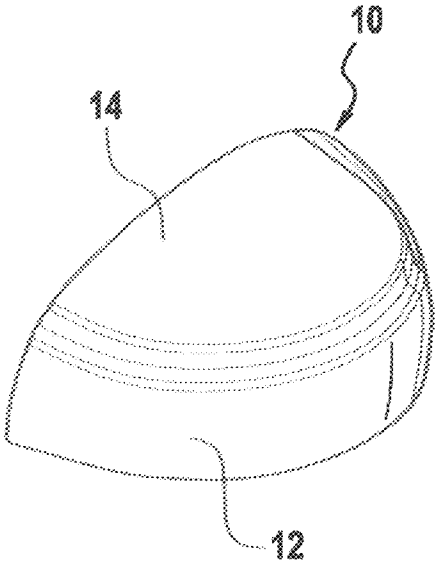

| | | | | |
|---|---|---|---|---|
| 2022/0110412 | A1 | 4/2022 | Roser | |
| 2023/0016881 | A1 * | 1/2023 | Boissonneault ..... | A42B 3/20 |

FOREIGN PATENT DOCUMENTS

| | | | |
|---|---|---|---|
| EP | 3 257 391 | A1 | 12/2017 |
| GB | 191510704 | A | 7/1916 |
| WO | 2014/007818 | A1 | 1/2014 |
| WO | 2015015477 | A1 | 2/2015 |

* cited by examiner

TOE CAP AND METHOD FOR PRODUCING A TOE CAP

The invention relates to a method for producing a toe cap and to a toe cap.

Toe caps, also known as toe protection caps, come in a large number of varieties and primarily consist of metal. As an example, reference is made to a toe cap in EP 1 066 786 A1, which can consist of metal or a carbon fiber-reinforced plastic and has a large number of holes that vary in size and arrangement.

EP 2 286 686 A1 and EP 2 298 112 A1 describe toe caps that have openings that are characterized by a honeycomb structure. Other geometries of openings in the form of, for example, slots or triangles can be found in US 2008/0115387 A1 or US 2011/0185602 A1.

Corresponding toe caps can be manufactured using metal injection molding (MIM) methods (US 2011/0185602 A1). In the injection molding method according to WO 2014/007818 A1, a toe cap is produced that has reinforcing structures on the inside.

EP 3 257 391 A1 relates to a non-metallic protective cap having inner and outer plates separated by partitions to form cells into which an elastomer or thermoplastic material is injected.

A large number of toe caps, in particular made of metal, have disadvantages in terms of weight, regardless of the existing recesses, so that a shoe having a corresponding toe cap cannot offer the desired comfort for the user. There is also often no ventilation to the extent required.

The present invention is based on the object of providing a protective cap and a method for producing such a cap, which is optimized in particular in terms of its weight, while at the same time meeting the necessary safety requirements, in particular the relevant norms. Adequate air flow is to be possible.

To solve the problem, a method is essentially proposed for producing a toe cap, comprising the method steps 1) specifying a master cap that has at least one defined parameter that is characteristic of a toe cap to be produced,
2) simulating a virtual cap corresponding to the master cap according to a simulation method,
3) simulating the virtual cap in such a way that the value of a first simulated characteristic parameter corresponding to the defined characteristic parameter corresponds to that of the defined characteristic parameter of the master cap or lies within a predetermined tolerance range thereof,
4) modifying the structure of the virtual cap,
5) calculating the value of the simulated characteristic parameter of the structurally modified virtual cap and comparing it with the value of the characteristic parameter according to step 1) and/or step 3),
6) modifying the structure of the virtual cap again, if
   a) according to step 5), a deviation is determined that lies outside a predetermined tolerance range, and then recalculating the characteristic parameter, or
   b) if the characteristic parameter lies within the tolerance range, if the structure modified according to step 4) does not meet a specified criterion,
7) if necessary, repeating process steps 4) to 6) until the calculated value of the characteristic parameters lies within the specified tolerance range,
8) producing the toe cap based on the virtual cap having the modified structure, for which the simulated characteristic parameter lies within the predetermined value range of the first simulated characteristic parameter.

In particular, it is provided that the finite element method will be used as a simulation method. The virtual cap is divided into finite elements of a size such that the value of a first simulated characteristic parameter corresponding to the defined characteristic parameter corresponds to that of the defined characteristic parameter of the master cap or lies within a predetermined tolerance range thereof, In principle, the master cap used is one that is provided by means of a computer-aided design (CAD) and that has the defined characteristic parameter, in particular the minimum remaining height under the toe cap upon impact and pressure action, such as that defined in DIN ISO 22568-1:2020-01. Of course, another characteristic parameter can also be used as a basis.

If there is preferably a digital master cap on the basis of the data of which the simulation is carried out, a real cap can of course also be used, from which CAD data are then made available.

The master cap that can be used in particular is one that is a closed body, i.e., a cap without openings, wherein the wall thickness is additionally the same at least in the end wall area and in the cover wall covering the toes on the upper side. This is also to applied to the lower edge wound inward. Of course, the inventive teaching is not restricted by the relevant preferred additional conditions.

Independently of the above, the characteristic parameter of the master cap corresponds to the characteristic parameter that a real cap has to have, such as the minimum remaining height under the toe cap upon impact and pressure action.

Based on a corresponding master cap, a virtual cap is simulated in particular according to the finite element method. The simulated cap has an external geometry that corresponds to the master cap, which in turn corresponds to a real toe cap to be produced in terms of the external geometry.

Furthermore, the virtual cap has an envelope geometry that corresponds to that of the master cap, which is in particular a closed body. In other words, the master cap can have a closed surface, i.e., can be a closed body whose wall thickness can remain unchanged across the body.

The material parameters also correspond.

If the finite element method is particularly suitable as a simulation method, other suitable simulation methods can of course also be used.

A simulation is carried out in such a way that at least one characteristic parameter that characterizes the master cap, in particular the minimum remaining height required by DIN EN ISO 22568-1:2020-01 upon impact and pressure action tested according to this standard, is equal or approximately equal in value in the simulated cap, i.e., lies within a specified tolerance or value range. The minimum remaining height is that which is present perpendicular to the contact surface below the protective cap, which cannot fall below the value of 21 mm for a size 8 metallic toe cap for protective shoes (see point 4 of DIN EN ISO 22568-1:2020-01).

The simulated cap is divided into sub-areas, i.e., into the finite elements in the case of the finite element method, to such an extent that the corresponding simulated characteristic parameter corresponds or approximately corresponds to the value of the characteristic parameter of the master cap. Approximately means that specified tolerance ranges have to be adhered to.

If a corresponding virtual cap is simulated, the structure is modified in order to achieve optimization, for example in terms of weight or ventilation, wherein defined characteristic parameters have to correspond to value specifications, in particular norms.

The modified structure is carried out automatically taking into consideration the specified parameters such as weight or area, wherein area can be the closed area or the area of the simulated cap to be modified by openings or material modifications in comparison to the virtual initial cap (step 2).

However, it is also possible for the user to specify in which area structural modifications should or should not be made.

The value of the defined characteristic variable is recalculated from the virtual cap having a modified topology. If the values are outside a predetermined range, i.e., a predetermined tolerance, a further modification is made to the structure, from which the value of the simulated characteristic parameter is also calculated and is then compared with the corresponding characteristic parameter of the master cap or the original virtual cap. If the values are outside a predetermined range, the structure is modified again in order to then calculate the simulated characteristic parameter. A method in this regard, which can be referred to as an iteration method, can be continued until the simulated characteristic parameter lies within the predetermined value range after the last modification, in order to then produce real toe caps on the basis of the virtual cap designed in this way.

However, there is also the possibility of making a further modification to the structure if the topology of a virtual cap already meets the value of the characteristic parameter, for example if areas of the virtual cap have openings that could result in toes being excessively stressed, in particular in the area of the wall of the toe cap, which extends directly above the toes. Corresponding desired changes are specified by the user in order to then modify the remaining topology of the virtual cap by simulation so that the desired structure is achieved while at the same time the characteristic parameter is met.

The modification of the structure is carried out by changing the mass or surface of the virtual model. Surface of the model means that the arrangement and/or formation of through openings and/or surface enlargements is carried out by material removal or material thickening. These measures can take place alternatively or at least partially cumulatively.

If there is a further modification to the structure according to step 6), this is done by at least one measure from the group of formation of through openings, modification of through openings, material removal, material thickening, formation or modification of webs or areas in the virtual cap delimiting through openings or depressions.

In the first structural modification according to step 4), it is in particular provided that areas of the virtual cap are removed and/or material removals take place in areas in which a force flow does not occur or does not occur significantly or is less in comparison to other areas. The path of a force from the point of introduction to the point where it is absorbed by a reaction force can be represented and thus also simulated by a force flow line.

In order to calculate the simulated characteristic parameter, a simulated pressure test and/or a drop test is carried out, which is also used to determine the characteristic parameter of a real cap.

In particular, the characteristic parameter to be selected is the maximum permissible deformation of the cap perpendicular to the contact surface of the cap, i.e., the minimum remaining height specified in DIN EN ISO 22568-1:2020-01, which for a size 8 metal toe cap of a type A as an inner toe cap is 21.0 mm.

Additionally or alternatively to the maximum permissible deformation as a characteristic parameter, at least one further parameter, in particular a material parameter from the group of tensile strength, yield point, uniform elongation, mechanical stress, and comparison stress can be used as a characteristic variable for the virtual design of the toe cap to be produced.

In particular, the comparison stresses of individual areas of the virtual toe cap are used to make modifications to the structure, i.e., the topology, in particular in step 6) depending on the calculated values.

In particular, it is provided that recesses and/or depressions are simulated in the area having a comparison stress of up to at most 90% of the maximum comparison stress occurring in the simulated cap and/or modifications of the structure do not occur in areas having a comparison stress of more than 90% of the maximum comparative stress occurring in the simulated cap.

For example, for a simulated cap that corresponds to a size 8 real cap according to DIN EN ISO 22568-1:2020-01, modifications are not made in the structure in areas in which a comparison stress of more than 1000 MPa, in particular more than 1200 MPa prevails. In areas below these comparison stress values, recesses and/or depressions, i.e., material removals, can be made without through openings having to result.

The toe cap to be produced on the basis of the virtual cap is produced in particular by injection molding, in particular metal injection molding, in the die-casting method, in the lamination method, or in the additive method.

Forming material, such as deep drawing metal, can also be considered as a manufacturing method.

It is furthermore possible to process or rework the cap by means of laser, water jet cutting, or milling. Recesses can be produced or reworked. The same applies to material thinning.

The material of the toe cap can be metal, in particular tool steel, or plastic, in particular fiber-reinforced plastic or aramids.

A toe cap, comprising at least one end wall extending in an arch shape and a cover wall extending therefrom that covers the toes on the upper side, wherein the cover wall and the end wall having a base wall thickness W and areas separated from sections of the walls, such as webs in the walls, have a thickness D with $0 \leq D < W$, possibly $D=0$, is characterized in that the difference between the volume of the toe cap with areas filled to the base wall thickness W and the volume of the toe cap with the areas of lesser thickness is 5% to 35%, in particular 10% to 30%, preferably 20% to 30%, and/or the difference between the area of the toe cap with filled areas and the outer surface of the toe cap without the areas is 20% to 60%, preferably 30% to 60%, in particular 40% to 60%.

The base wall thickness is the wall thickness in which the wall, i.e. the cover wall and the end wall, does not have any areas of thickness D.

The areas themselves can be through openings and/or depressions in the walls, without the latter completely penetrating the walls.

A toe cap, comprising at least one end wall extending in an arch shape and a cover wall extending therefrom that covers the toes on the upper side, wherein the cover wall and the end wall having a base wall thickness W and areas separated from sections of the walls, such as webs in the walls, have a thickness D with 0≤D<W, possibly D=0, is characterized in that the difference between the volume of the toe cap with areas filled to the base wall thickness W and the volume of the toe cap with the areas of lesser thickness is 5% to 35%, in particular 10% to 30%, preferably 20% to 30%, and/or the difference between the area of the toe cap with filled areas and the outer surface of the toe cap without the areas is 20% to 60%, preferably 30% to 60%, in particular 40% to 60%.

In a refinement, the invention provides that the through openings have edge boundaries that are inclined towards at least one surface, in particular towards the outside of the toe cap.

The invention is also characterized in that recesses and/or depressions are provided in areas of the toe cap having a comparison stress of up to 90% and/or closed surfaces are provided in areas of the toe cap having a comparison stress of more than 90%.

It is particularly preferred that the toe cap has areas of lesser thickness in regions of a comparison stress between 0 and 1200 MPa and/or has the base wall thickness in regions of a comparison stress greater than 1200 MPa, based on a size 8 toe cap according to DIN EN ISO 22568-1:2020-01.

It is possible that the toe cap is made of metal, in particular tool steel, or plastic, in particular fiber-reinforced plastic or aramids.

It is preferably provided that the toe cap is an injection-molded body, in particular a metal injection-molded body, a die-cast body, a body produced using the lamination method, or a body produced using the additive method.

It is also provided that groups of areas of lower density, in particular groups of through openings, are surrounded by a common edge that is chamfered.

A toe cap, comprising at least one end wall extending in an arch shape and a cover wall extending therefrom that covers the toes on the upper side, wherein the cover wall and the end wall having a base wall thickness W and areas separated from sections of the walls, such as webs in the walls, have a thickness D with 0≤D<W, possibly D=0, is characterized in that the volume of the toe cap with areas filled to the base wall thickness W is reduced in relation to the volume of the toe cap with the areas of lesser thickness by 5% to 35% and/or the area of the toe cap with filled areas is reduced in relation to the outer surface of the toe cap without the areas by 20% and 60%, and that in areas of the toe cap with a comparison stress of up to 90% of the maximum comparison stress recesses and/or depressions are provided and/or in areas of the toe cap with a comparison stress more than 90% of the maximum comparison stress closed surfaces are provided.

A toe cap, comprising at least one end wall extending in an arch shape and a cover wall extending therefrom that covers the toes on the upper side, wherein the cover wall and the end wall having a base wall thickness W and areas separated from sections of the walls, such as webs in the walls, have a thickness D with 0≤D<W, possibly D=0, is also characterized in that the volume of the toe cap with areas filled to the base wall thickness W is reduced in relation to the volume of the toe cap with the areas of lesser thickness by 5% to 35% and/or the surface of the toe cap with filled areas is reduced in relation to the outer surface of the toe cap without the areas by 20% and 60%, and that the through openings have edge boundaries that are inclined towards at least one surface, in particular towards the outside of the toe cap, that groups of through openings are surrounded by a common edge that is chamfered.

Refinements of the invention also result from the dependent claims

Additional details, advantages, and features of the invention will be apparent not only from the claims and the features specified therein—alone and/or in combination—but also from the following description of preferred exemplary embodiments.

Figure 3:
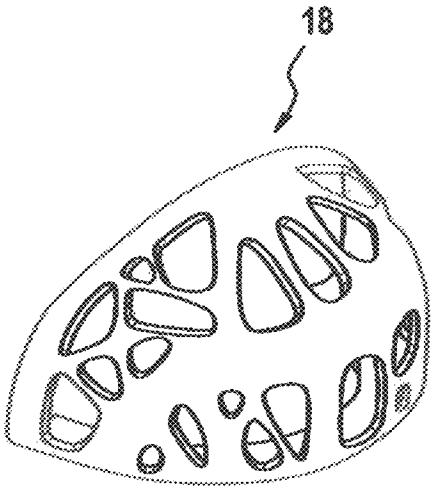
Figure 4:
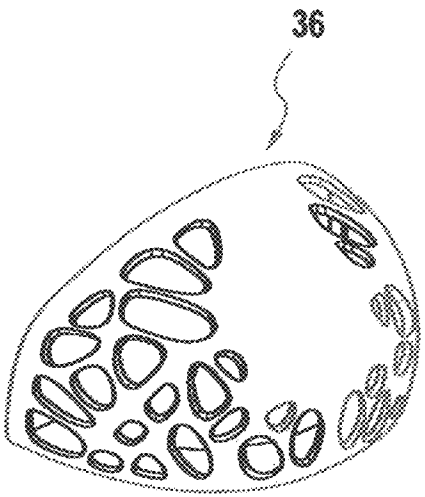
Figure 2:
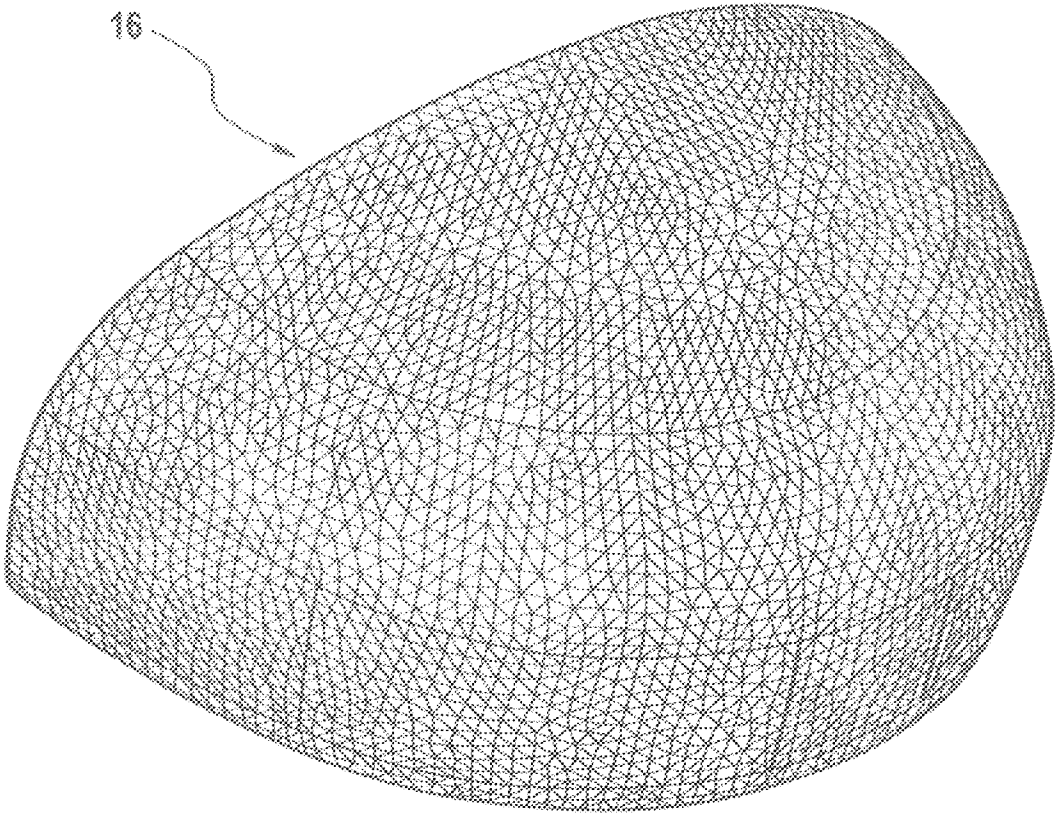
Figure 6:
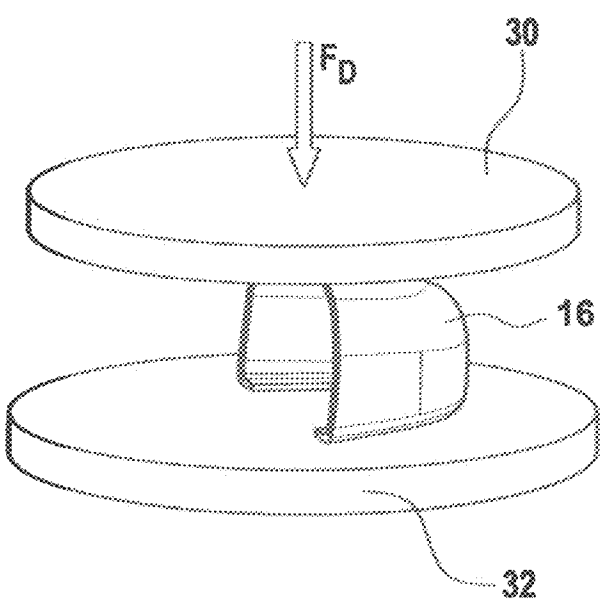
Figure 5:
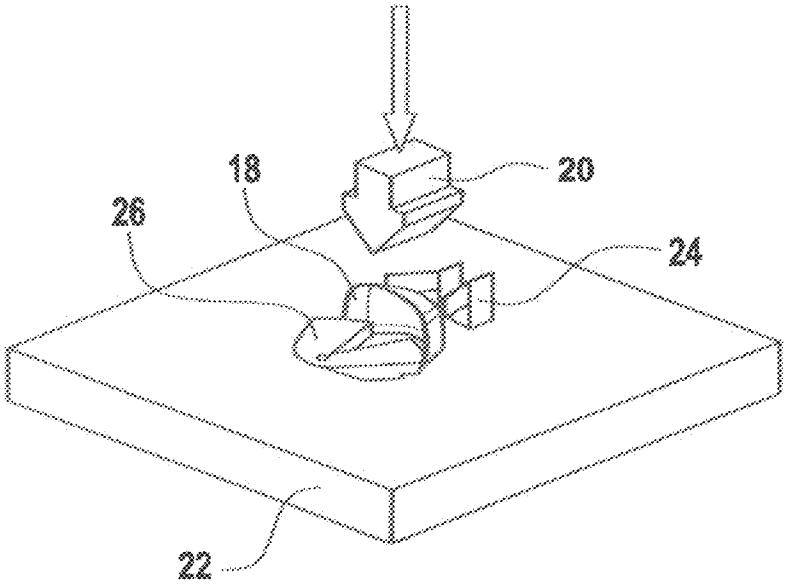
Figure 8:
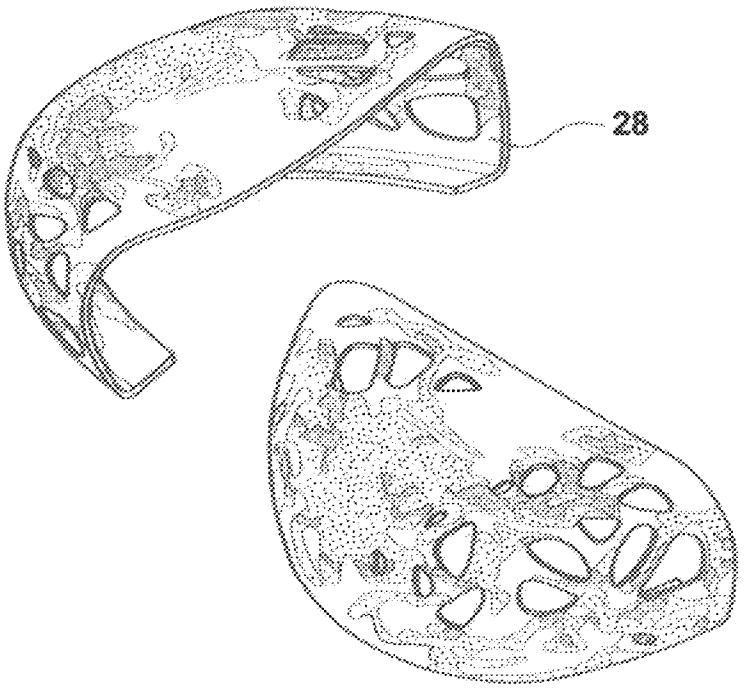
Figure 7:
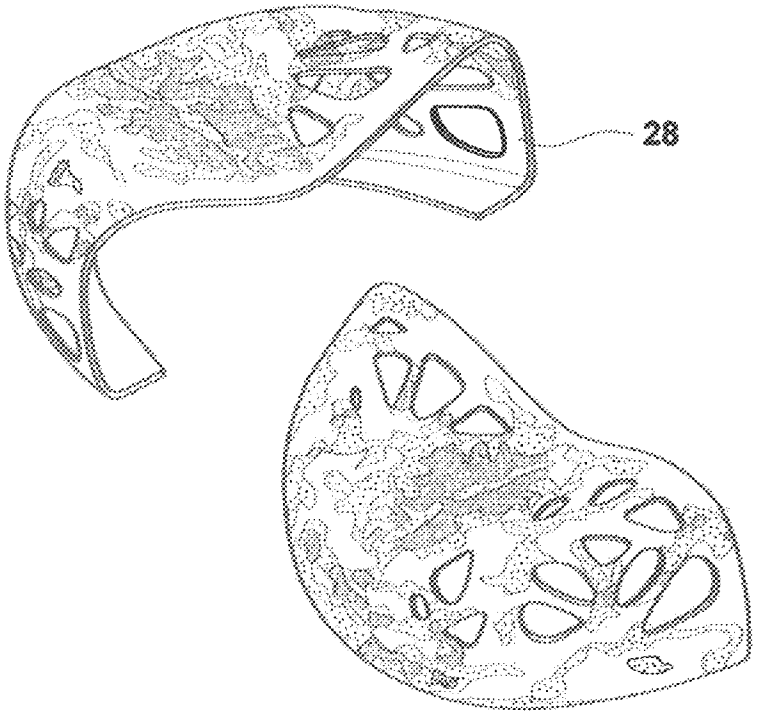
Figure 9:
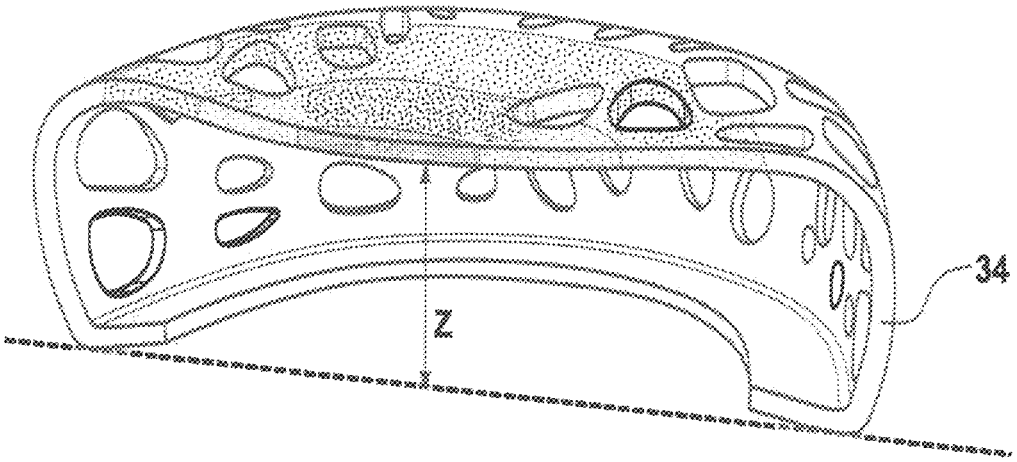
Figure 10:
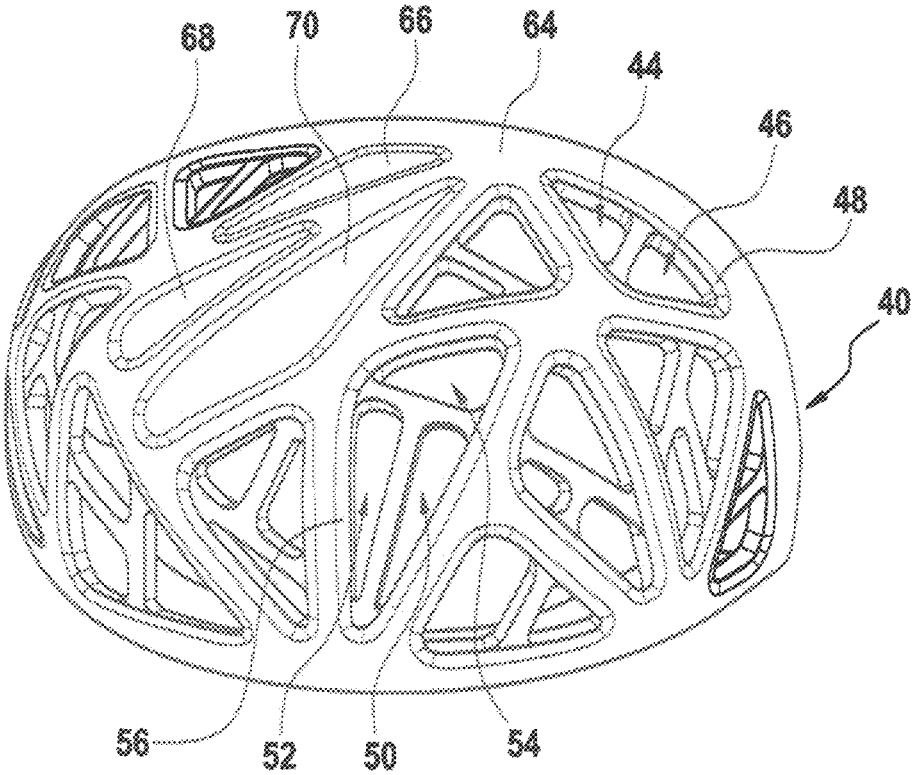
Figure 11:
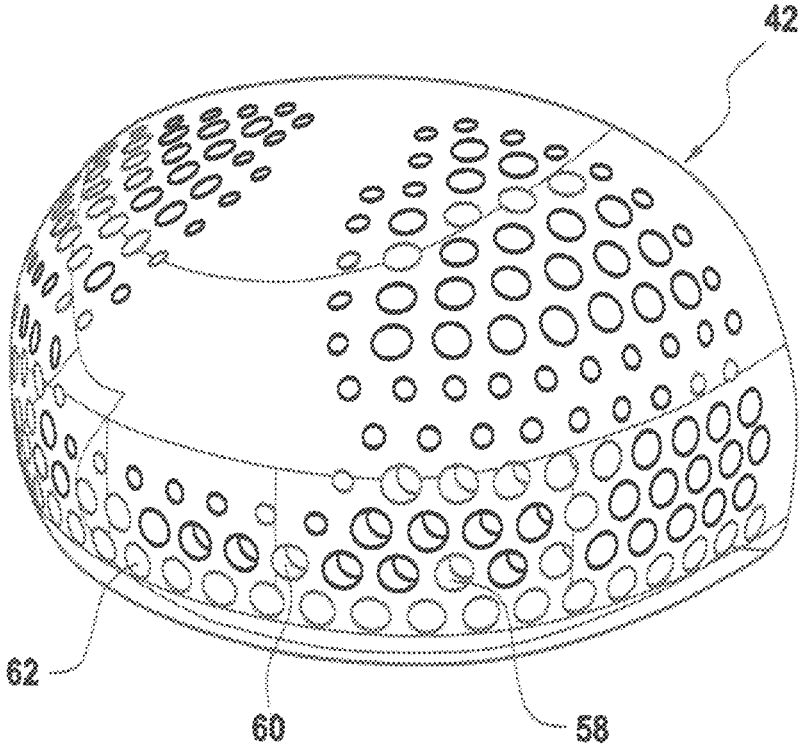

In the figures:

FIG. 1 shows a schematic representation of a closed master cap,

FIG. 2 shows a toe cap simulated using the finite element method corresponding to the master cap, FIG. 3 shows the simulated toe cap according to FIG. 2 after a first structural modification, FIG. 4 shows the simulated toe cap after a second structural modification, FIG. 5 shows a schematic representation of the drop test standard test, FIG. 6 shows a schematic representation of the pressure test standard test, FIG. 7 shows a simulation result of comparison stress during a drop test on the simulated toe cap according to FIG. 2, FIG. 8 shows a result of a simulated pressure test on the simulated toe cap according to FIG. 2, FIG. 9 shows another view of the result of the pressure test in relation to the deformation of the simulated toe cap in the Z direction, FIG. 10 shows a first example of a structurally optimized toe cap, and FIG. 11 shows a second example of a structurally optimized toe cap.

The teaching according to the invention for producing a toe cap is to be explained based on the figures, wherein in the exemplary embodiment a toe cap is simulated using the finite element method, which is optimized in terms of mass and/or ventilation, to then, based on the CAD-Data from the simulated cap, produce a real toe cap that is used as an inner toe cap, wherein different minimum remaining heights in accordance with DIN EN ISO 22568-1:2020-01 have to be achieved depending on whether the toe cap is used for protective shoes or for safety shoes.

When simulating corresponding caps, a master toe cap—also called a master cap—according to FIG. 1 is assumed, which is a closed body, i.e., the surface is completely closed and the wall thickness W is of constant thickness, i.e., the toe cap 10 has the same wall thickness both in the curved end wall 12 and in the cover wall 14 covering the toes on the upper side. Of course, the master cap can also be a body that already has openings and/or does not have a constant wall thickness.

An inner edge can extend from the bottom area of the peripheral wall 12, an edge that is angled inwards and lies in one plane.

The master toe cap is in particular a computer-aided design (CAD) of a real cap, wherein the material characteristics of the real cap are taken into consideration.

From the master cap 10, a toe cap 16 is simulated using the finite element method, which is divided into a finite number of sub-areas, i.e., finite elements. A subdivision takes place to the extent that the simulated cap 16 has the same value in relation to a characteristic parameter of the master cap 10. The characteristic parameter of the master cap 10 corresponds to the characteristic parameter of a real cap. In particular, the deformation of the cap in the Z direction, i.e., perpendicular to a plane which is spanned by the lower edge of the end wall 12 or the inwardly directed edge, is used as a characteristic parameter. The plane thus extends parallel to a surface on which the edge of the cap rests.

According to DIN EN ISO 22568-1:2020-01, the deformation in the Z direction cannot be less than 21 mm for a size 8, for example, for a type A metallic inner toe cap intended for protective shoes. For a metallic toe cap for safety shoes, the value is 25 mm. Corresponding toe caps are inserted underneath the upper part of a shoe.

In order to simulate the toe cap 16, the material parameters of the master cap, i.e., therefore a real cap, were taken into consideration. For example, when using tool steel 1.2709, the tensile strength was specified as 1280 MPa and the yield strength as 1080 MPa.

The simulated cap 16, which met the value of the characteristic parameter, was then structurally modified, alternatively volume modifications or surface modifications or both volume modification and surface modification being specified as parameters to be modified.

Area modification means that recesses were introduced into the simulated cap 16, wherein the total area of the recesses is set in relation to the total area of the closed simulated cap 16. For the volume parameter, the volume of the simulated cap 16 was set in relation to the volume of the structurally modified simulated toe cap.

In order to determine after a structural modification has been made whether it meets the requirements of the master cap, at least in terms of the deflection in the Z direction, in particular also with regard to stress distribution and plastic elongation, corresponding calculations were carried out on the simulated cap and compared with real values.

A corresponding structurally modified simulated toe cap after a first structural modification can be seen in FIG. 3 and is identified by the reference numeral 18.

In order to determine the desired parameters, tests were simulated. FIG. 5 shows the model with which a drop test was carried out to determine stress distribution, plastic elongation, and maximum deformation. The impact of a falling body having a mass of 20 kg from a height of 1 m onto the cap 18 was simulated.

The model had a base plate 22, a holding fork 24, a rounded plate 26, and the falling body 20. The simulated toe cap 16 was positioned on the base plate 22 between the holding fork 24 and the rounded plate 26. Fall body 20, base plate 22, holding fork 24, and rounded plate 26 were rigid bodies made of steel. The test specimen, i.e., the simulated toe cap 18, consisted of tool steel 1.2709.

The drop test was carried out taking these parameters into consideration. FIG. 7 shows the result on a structurally modified toe cap 28, wherein the tensile strength of 1280 MPa and the yield strength of 1080 MPa were taken into consideration as a reference for the calculated comparison stress. The ranges of different comparison stresses can be seen, wherein the maximum stress was above the failure limit.

Simulated pressure tests were also carried out on simulated toe caps in accordance with DIN EN ISO 22568-1:2020-01. The simulated setup of the pressure test can be seen in FIG. 6. This shows, purely in principle, the simulated toe cap 16 to be tested, which was positioned between an upper plate 30 and a lower plate 32. The lower plate 32 was made of steel and had a diameter of 150 mm and the upper plate 30 had a diameter of 141 mm. The material was also steel. The material for the simulated toe cap 16 was tool steel 1.2709. During the pressure test, a force of up to a maximum of kN or 20 kN was applied in 1 kN increments.

An example of a pressure test result for the simulated cap 28 at a force of 15 kN can be seen in FIG. 8, in which the comparison stress in the simulated toe cap 26 is shown.

FIG. 9 also shows the deformation in the Z direction on a further structurally modified toe cap 34, wherein the characteristics of the tool steel 1.2709 have been taken into consideration with regard to tensile strength and yield point.

With a force of 15 kN, which acted in addition to the gravitational load, a maximum deformation resulted such that the minimum remaining height in the Z direction, i.e., in the perpendicular to the support surface on the lower plate 32, on which the inwardly directed edge rested of the simulated toe cap 28 on which the simulated test is based met the standard.

If the finite element method reveals an impermissible deviation from the specified value with regard to the characteristic parameter to be checked, taking into consideration specifications, in particular the specification according to DIN EN ISO 22568-1:2020-01, a further structural modification was made, for example, openings have been enlarged or reduced and/or offset or the thickness of the wall has been modified in areas.

This will be described by way of example in reference to FIGS. 3 and 4. The simulated cap 18 did not meet the requirement regarding the specified characteristic parameter or parameter, so that a modification in the structure, i.e., a structural optimization, was carried out. The structural modification resulted in the simulated cap 36. A change can be seen in the arrangement of the openings and in particular the closed surface in the middle area of the cover wall 14. Modifications in this regard were made taking into consideration the comparison stresses resulting from the simulation. The simulation showed that for a size 8 metallic toe cap according to DIN EN ISO 22568-1:2020-01, recesses are possible in the areas in which the comparison stress was less than 1200 MPa, whereas in areas above this value recesses are to be avoided.

During the first structural modification, i.e. in the cap 16, openings were formed in the areas in which no or essentially no force flow was determined in the drop test and in the pressure test on the simulated toe cap 16.

Structural modifications are made to an extent until a simulated toe cap results that meets the requirements with regard to the characteristic parameter or characteristic parameters that are specified and have to be met by a real cap.

On the basis of the corresponding simulated toe cap, toe caps are then produced, in particular using the die-casting method, metal injection molding method, lamination method for caps made of fiber composite material, or in additive methods.

Forming material, such as deep drawing metal, can also be considered as a manufacturing method.

It is furthermore possible to process or rework the cap by means of laser, water jet cutting, or milling. Recesses can be produced or reworked. The same applies to material thinning.

The material for caps is metal, preferably steel, in particular tool steel, although fiber-reinforced plastics, for example, can also be used.

Based on the teaching according to the invention it follows that the volume of a toe cap produced according to the invention can be reduced between 5% and 35% in comparison to one having a closed surface, in particular in the range between 20 and 30%.

Alternatively or additionally, the surface of the cap can be reduced between 20% to 60%, in particular between 40% and 60%, i.e., a cap having a completely closed surface in comparison to one according to the invention which has recesses, such as openings, or areas of low wall thickness.

In particular, toe caps are also producible, which allow good ventilation due to the openings, i.e., heat build-up is avoided. Examples of corresponding toe caps 40, 42 are shown in FIGS. 10 and 11. These also illustrate that the type of openings can basically be chosen arbitrarily. The openings in the toe cap 40 are formed by triangles, wherein triangles are combined into groups that are surrounded by a common edge that is inclined towards the surface. Chamfers are therefore present. This is illustrated, for example, by the triangular openings 44, 46 and the common edge 48 surrounding them or by the openings 50, 52, 54 and the common surrounding chamfered edge 56.

In FIG. 11, the openings are formed by circular openings, some of which are identified by way of example with the reference numerals 58, 60, 62.

If volume changes, i.e., changes in mass, are primarily achieved due to through openings, reductions can also be achieved by forming depressions in the toe cap alternatively or additionally to through openings, i.e., material removal takes place, as is also illustrated in FIG. 10. In the middle area of the toe cap 40, namely in the cover wall 64, recesses 66, 68, 70 are provided, which result in a reduction in volume and thus mass.

The invention claimed is:

1. A method for producing a toe cap, comprising the steps of:

step 1) specifying a master cap that has at least one defined parameter that is characteristic of a toe cap to be produced, step 2) simulating a virtual cap corresponding to the master cap according to a simulation method, step 3) simulating the virtual cap in such a way that a value of a first simulated characteristic parameter corresponding to the defined characteristic parameter corresponds to that of the defined characteristic parameter of the master cap or lies within a predetermined tolerance range thereof, step 4) modifying the structure of the virtual cap, step 5) calculating the value of the simulated characteristic parameter of the structurally modified virtual cap and comparing it with the value of the characteristic parameter according to step 1) and/or step 3), step 6) modifying the structure of the virtual cap again, if a) according to step 5), a deviation is determined that lies outside a predetermined tolerance range, and then recalculating the characteristic parameter, or b) if the characteristic parameter lies within the tolerance range, if the structure modified according to step 4) does not meet a specified criterion, step 7) if necessary, repeating process steps 4) to 6) until the calculated value of the characteristic parameters lies within the specified tolerance range, and step 8) producing the toe cap based on the virtual cap having the modified structure, for which the simulated characteristic parameter lies within the predetermined value range of the first simulated characteristic parameter;

wherein modifying the structure of the virtual cap in step 6 is carried out by at least one of:

creating and/or modifying a variety of through openings by material removal, thickening of material, forming or modifying areas in the virtual cap delimiting through openings or depressions.

2. The method according to in claim 1, wherein, in step 2), a finite element method is used, and wherein a closed body, the wall thickness W of which is uniform over the body, is used as the master cap specified according to step 1).

3. The method according to claim 2, wherein the virtual cap is divided into finite elements such that the value of a first simulated characteristic parameter corresponding to the defined characteristic parameter corresponds to that of the defined characteristic parameter of the master cap or lies within a predetermined tolerance range thereof.

4. The method according to claim 1, wherein, as the at least one specified criterion in step 6)b) arrangement and/or geometry of one or more recesses in an area of the virtual cap is selected which extends above the toes to be covered, wherein preferably upon the modification of the structure according step 6)b), a specification takes place by a user before the simulation to be carried out.

5. The method according to claim 1, wherein the modification of the structure according to step 6) is done by at least one measure from the group of formation of the through openings, modification of the through openings, material removal, material thickening, formation or modification of webs or areas in the virtual cap delimiting the through openings or the depressions.

6. The method according to claim 1, wherein, in method step 4), areas of the virtual cap are removed and/or material removals take place, wherein in the areas, a force flow does not occur or does not occur significantly or is less in comparison to other areas.

7. The method according to claim 1, wherein, to calculate the simulated characteristic parameter, a simulation of a pressure test and/or a drop test is carried out.

8. The method according to claim 1, wherein the maximum permissible deformation of the cap perpendicular (Z direction) to the contact surface (X-Y plane) of the cap is selected as the characteristic parameter, wherein additionally or alternatively to the maximum permissible deformation, at least one further material parameter selected from the group consisting of tensile strength, yield point, uniform elongation, mechanical stress, and comparison stress is selected.

9. The method according to claim 1, wherein comparison stresses of individual areas are computed of the virtual cap, computed according to step 3), and wherein modifications of the structure at least according to step 6) take place depending on computed values of comparison stresses.

10. The method according to claim 1, wherein recesses and/or depressions are simulated in areas having a comparison stress of up to 90% of the maximum comparison stress occurring in the simulated cap and/or modifications in the structure do not take place in areas having a comparison stress of more than 90% of the maximum comparison stress occurring in the simulated cap, and/or recesses and/or depressions are simulated in areas having a comparison stress between 0 and 1200 MPa and/or modifications in the structure, which corresponds to a size 8 real cap made of metal according to DIN EN ISO 22568-1:2020-01 do not take place in areas of a comparison stress ≥1200 MPa.

11. The method of claim 1, wherein the modification of the structure is carried out by changing the mass and/or a surface of the virtual cap.

* * * * *